United States Patent [19]

Tiffany

[11] Patent Number: 4,737,996

[45] Date of Patent: Apr. 19, 1988

[54] SEAT-BED CONVERSION ASSEMBLY

[75] Inventor: H. Robert Tiffany, Philadelphia, Pa.

[73] Assignee: Tiffany and Tiffany, Designers, Inc., Philadelphia, Pa.

[21] Appl. No.: 909,884

[22] Filed: Sep. 22, 1986

[51] Int. Cl.[4] ..... A47C 17/13; A47C 17/17; A47C 17/207

[52] U.S. Cl. ..... 5/47; 5/37 R; 5/42

[58] Field of Search ..... 5/47, 48, 41, 37 R, 5/37 B, 42

[56] References Cited

U.S. PATENT DOCUMENTS

| | | | |
|---|---|---|---|
| 2,126,588 | 8/1938 | Thum | 5/45 |
| 2,247,546 | 7/1941 | Donoho . | |
| 2,248,603 | 7/1941 | Bell . | |
| 2,319,337 | 5/1943 | McDaniel | 5/47 |
| 2,321,206 | 6/1943 | Holcomb | 5/47 |
| 2,634,430 | 4/1953 | Rogers | 5/44 |
| 3,124,388 | 3/1964 | Berlin | 5/48 |
| 3,151,342 | 10/1964 | McLean | 5/29 |
| 3,317,930 | 5/1967 | Wiberg | 5/42 |
| 4,563,784 | 1/1986 | Shrock et al. | 5/37 |
| 4,620,335 | 11/1986 | Dodgen | 5/47 |

FOREIGN PATENT DOCUMENTS

| | | | |
|---|---|---|---|
| 449460 | 9/1927 | Fed. Rep. of Germany . | |
| 475646 | 11/1927 | United Kingdom | 5/47 |
| 287989 | 4/1928 | United Kingdom . | |

*Primary Examiner*—Alexander Grosz

[57] ABSTRACT

An improved seat-bed assembly providing a seat unit and a back frame support, both of which are interconnected by a controlled linkage that, coupled with a guided movement of the back frame support, will convert the assembly from a seat form to a full length bed. Pivotal withdrawal of the seat unit from the assembly will, through a drag link arrangement, pivot the back frame support through a guided path into a bed forming position with the now extended seat unit.

5 Claims, 2 Drawing Sheets

SEAT-BED CONVERSION ASSEMBLY

SUMMARY OF THE INVENTION

This invention relates to an improved convertible seat-bed assembly and will have special application to a controlled linkage arrangement whereby each section of the seat-bed assembly moves in unison and in response to movement of one another such that a seat form may be readily converted into a bed.

More specificaly, the invention relates to an arrangement of parts by which a seat and subseat and a related back rest can be converted into a full length sleeper-type bed. The arrangement provides for a two-part collapsible seat portion for the chair or sofa unit which, through suitable linkage, is connected with the back rest portion of the unit which in its converted position becomes an extension of and forms the full length bed assembly. All of the movable parts are contained within arm frames provided by the chair. These arm frames are preformed to provide designed slots through which certain pivot points of the unit's back frame assembly moves in a controlled manner whereby a resulting collapsing or expanding motion is imparted by a drag link arrangement to the seat and subseat portion of the furniture.

STATE OF THE ART

Collapsible chair bed assemblies have been heretofore constructed of separate sections in which each part must be moved into their desired positions independently of each other with such movement being guided by preformed guiding slots. Such a construction is shown in U.S. Pat. No. 2,321,206 dated June 8, 1943. Other forms of convertibility from a chair to bed assembly, as shown in U.S. Pat. No. 2,248,603 dated July 8, 1941, where each of the sectional portions of the convertible furniture are connected together by links pivotally attached thereto. This arrangement normally requires a series of counter-balancing spring connections to the different links so as to maintain the furniture sections in their collapsed or extended position.

The present invention not only permits ready conversion of a chair to a full length bed but also provides for accomplishing such conversion by the forced movement of a single section of the furniture with the portions being arrested or locked in their different desired positions without the requirement of counter weights, springs, or latches.

BRIEF DESCRIPTION OF THE DRAWINGS

The invention will be best understood by reference to the accompanying drawings illustrating the preferred form of construction and mode of operation by which the stated objects of the invention are achieved and in which.

GENERAL DESCRIPTION OF THE INVENTION

Figure 1:
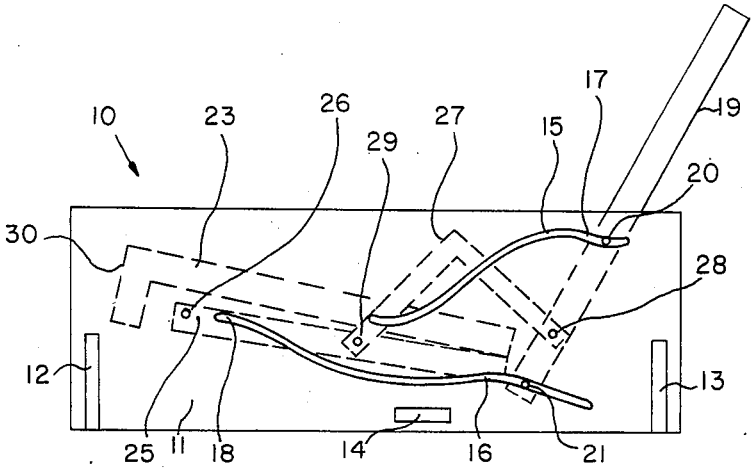
FIG. 1 is a side elevational view showing the structural parts of the seat bed conversion assembly in the seat forming position, including dotted lines showing some of the structure in a collapsed position.
Figure 2:
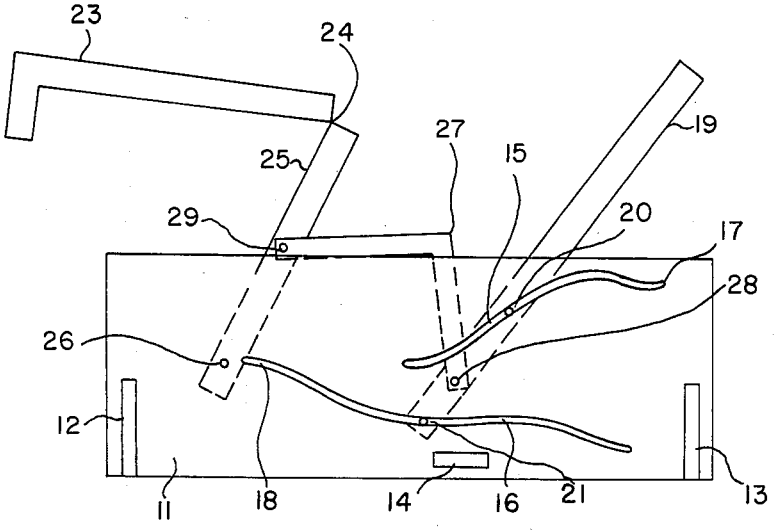
FIG. 2 is a side elevational view showing the seat bed conversion assembly in a partially convertible position.
Figure 3:
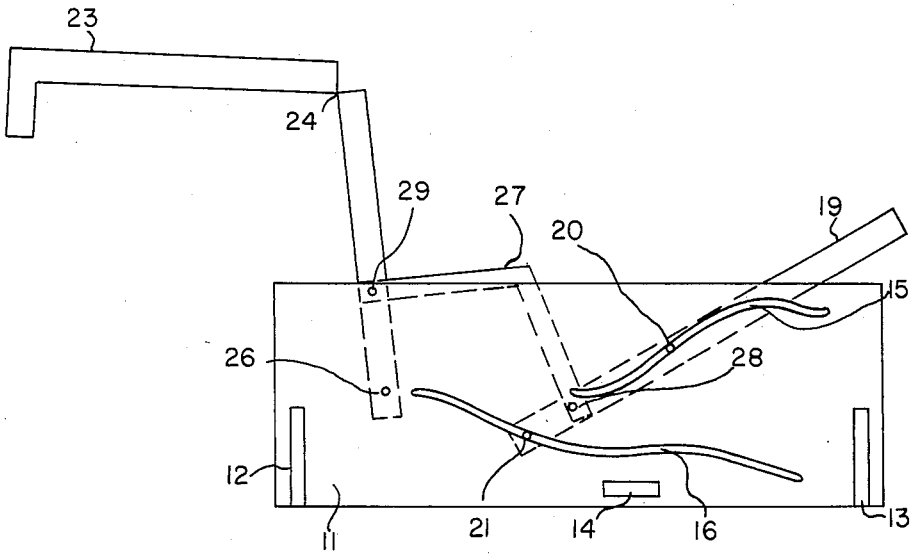
FIG. 3 is a side elevational view similar to FIG. 2 showing the seat bed conversion assembly in a further extended position.

The seat bed conversion assembly 10 provides parallel side arm frames 11 (only one shown) that are joined by a front cross rail 12 and a rear cross rail 13 as well as a bottom rail 14.

Each arm frame 11 on its inner confronting side surface has a set of tracks 15 and 16 formed therein. These tracks 15 and 16 are substantially vertically aligned and serpentine in design with a substantial horizontal travel. The upper track 15 is provided at its highest and rearward end with a slight gooseneck 17, the purpose and function of which will be hereinafter made apparent.

The back frame 19 as illustrated in the figures is shown as providing a pair of protruding guide pins 20 and 21, it being understood that a like pair of pins project from the opposite side end of the back frame 19 not shown.

The arrangement is such that the guide pin 20 rides in track 15 while guide pin 21 rides in and is guided by track 16. A seat section 23 provides a forwardly disposed depending leg 30 extending between the side arm frames 11 which may function as a closure for the front end of the chair when it is in its chair configuration.

Hinged at 24 to the inner end of the seat 23, is a subseat 25. The free end of the subseat 25 is pivoted upon a fixed pivot point 26 provided by the inner wall surface of the side arm frames 11. It should be noted that preferably this pivot point 26 is slightly elevated and adjacent to the front cross bar 12, such that when the subseat 25 is in its extended position as viewed in FIG. 4, it will rest upon and be supported by such cross rail 12.

A drag link 27 is adapted to be pivotally connected at 28 and 29 between the back frame 19 and the subseat 25. The function of the drag link 27 is to impart corresponding movement between the back frame 19 and the subseat 25 as they are converted from a "chair" to a full length "bed".

The conversion from "chair" to "bed" is accomplished by lifting the front of the seat 23 and pulling it out from between the arms 11, resulting in the coaction of the drag link 27 upon the back frame 19 and seat unit.

When the convertible furniture is in its "seat" position, the upper pin 20, as provided by the back frame 19, is positioned in the gooseneck 17, and this prevents the back frame 19 from any further backward movement. In the same position, the drag link 27, which is now balanced or braced between the back frame 19 and the subseat 25, will prevent the bottom of the back frame 19 from moving forward. This in turn will prevent the seat 23 and subseat 25 from attempting to be inadvertently transposed from the seat position to an extended bed-forming position.

Figure 4:
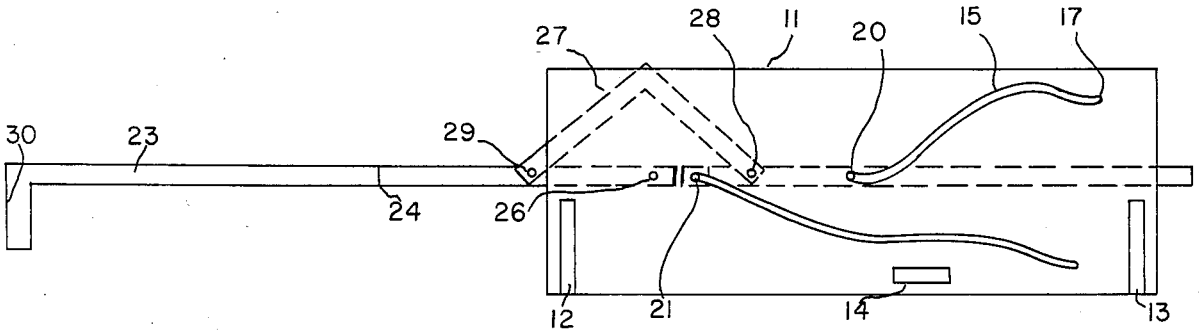
FIG. 4 is a side elevational view showing the seat bed of this invention in its fully converted position.

As shown in FIG. 4, when the back frame 19 has been collapsed into its bed-forming position, its pins 20 and 21 will have moved through their respective tracks 15 and 16 into the position shown. In such position, the pin 20 has moved into the lower and forward portion of track 15 while the corresponding pin 21 has moved through its track 16 into its elevated and forward position and into the gooseneck 18 where the pins, now almost in substantially horizontal alignment, will function to support the back frame 19 in such a collapsed position.

It should be noted that as the seat unit 23, 25 has been moved, the back frame 19 will have been forced to move through a clockwise, circular rotation about its pins 20 and 21 as they travel in their respective tracks 15 and 16. This movement has been caused by the action or movement of the drag link 27 which controls the positioning of the back frame 19, as shown in the sequence of positions, going from FIG. 1 through FIG. 4, the latter showing the fully converted position in which the subseat 25 now rests on the front cross rail 12 while the drag link 27 rests on the subseat pivot 26.

From the foregoing, it is apparent that I have provided for a seat bed conversion assembly which is simple in construction and economic to manufacture, the conversion being achieved by a minimum number of movable parts, all of which are sturdy in manufacture and therefore subject to continuous and successful use. The cooperation between the back frame 19, the seat 23, and its subseat 25, through the use of pivot points and the drag link, as well as the guided movement afforded by the guide tracks, permits an easy conversion of the piece of furniture from a "chair" to a full length "bed".

While the foregoing specification sets forth the invention in spcific terms, it is to be understood that numerous changes in the shape, size, and material may be resorted to without departing from the spirit and scope of the invention as claimed hereinafter.

Having described the invention, what is claimed as new is:

1. In an article of furniture, convertible from a chair to a bed, including:

(a) a frame providing spaced-apart side arm frames;

(b) a back frame positioned between said side arm frames and having a controlled limited movement therebetween;

(c) a seat unit pivotally connected about a horizontal axis between said side arm frames and adapted for distended pivotal movement relative thereto;

(d) means for guiding and controlling limited movement of said back frame between said side arm frames; and (e) means movably extending between said back frame and said seat unit whereby movement of one is imparted to the other so that they are convertible from a chair form to a bed form comprising a drag link, the opposite ends of which are pivotally connected to said back frame and said seat unit respectively.

2. In an article of furniture as defined by claim 1, wherein said means for guiding and controlling the limited movement between said back frame and said side arm frames, comprise a pair of spaced-apart tracks formed in the confronting side wall surfaces of said side arm frames, with said tracks being serpentine in form and functionally related so as to guide and pivot said back frame as it is converted from an upright vertical position to a substantial horizontal position.

3. In an article of furniture as defined by claim 1, wherein said means for guiding and controlling its limited movement comprises a pair of spaced-apart outwardly projecting pins adjacent the lower end of said back frame and positioned within the periphery of said side arm frames.

4. In an article of furniture as defined by claim 3, wherein said means for guiding and controlling the limited movement between said back frame and said side arm frames comprises tracks formed on the inner confronting wall surfaces of said side arm frames, with said pins provided by said back frame projecting therein for movement therethrough.

5. In an article of furniture convertible from a chair to a bed including:

(a) a frame providing spaced-apart side arm frames;

(b) cross rails adjacent the front and rear of said side arm frames for maintaining said side arm frames in spaced vertical relationship;

(c) a back frame positioned between said side arm frames and having a controlled limited movement therebetween;

(d) a subseat pivotally connected about a horizontal axis between said side arm frames;

(e) a seat hingedly connected to said subseat and adapted for distended pivotal movement relative thereto;

(f) means for guiding and controlling the limited movement between said back frame and said side arm frames;

(g) means providing a movable connection between said back frame and said means for guiding and controlling its limited movement; and (h) means movably extending between said back frame and said subseat whereby movement of one is imparted to the other so that they are converted from a chair form to a bed form, comprising a draq link, the opposite ends of which are pivotally connected to said back frame and said seat unit respectively.

* * * * *